US010222732B2

(12) United States Patent
Seki et al.

(10) Patent No.: US 10,222,732 B2
(45) Date of Patent: Mar. 5, 2019

(54) FIXING DEVICE HAVING A LATERAL END HEATER AND IMAGE FORMING APPARATUS INCORPORATING SAME

(71) Applicants: Takayuki Seki, Kanagawa (JP); Kenji Ishii, Kanagawa (JP); Hiroshi Yoshinaga, Chiba (JP); Takashi Seto, Kanagawa (JP); Ippei Fujimoto, Kanagawa (JP); Kazunari Sawada, Kanagawa (JP); Ryohei Matsuda, Kanagawa (JP)

(72) Inventors: Takayuki Seki, Kanagawa (JP); Kenji Ishii, Kanagawa (JP); Hiroshi Yoshinaga, Chiba (JP); Takashi Seto, Kanagawa (JP); Ippei Fujimoto, Kanagawa (JP); Kazunari Sawada, Kanagawa (JP); Ryohei Matsuda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/440,179

(22) Filed: Feb. 23, 2017

(65) Prior Publication Data

US 2017/0255147 A1 Sep. 7, 2017

(30) Foreign Application Priority Data

Mar. 3, 2016 (JP) ..... 2016-041328
Jan. 12, 2017 (JP) ..... 2017-003241

(51) Int. Cl.
*G03G 15/20* (2006.01)

(52) U.S. Cl.
CPC ..... *G03G 15/2053* (2013.01); *G03G 15/2039* (2013.01); *G03G 15/2042* (2013.01);
(Continued)

(58) Field of Classification Search
CPC ..... G03G 15/2039; G03G 15/2046; G03G 15/2053; G03G 15/2057; G03G 15/2078;
(Continued)

(56) References Cited

U.S. PATENT DOCUMENTS 5,499,087 A * 3/1996 Hiraoka ..... G03G 15/2064 219/216
2007/0014600 A1* 1/2007 Ishii ..... G03G 15/2039 399/328

(Continued)

FOREIGN PATENT DOCUMENTS

JP 2007-310220 11/2007
JP 2010-032631 2/2010

(Continued)

*Primary Examiner* — Joseph S Wong
(74) *Attorney, Agent, or Firm* — Oblon, McClelland, Maier & Neustadt, L.L.P.

(57) ABSTRACT

A fixing device includes a fixing rotator, an opposed rotator disposed opposite the fixing rotator, a pressure pad, a lateral end heater, and a thermal conduction aid. The pressure pad presses against the opposed rotator via the fixing rotator to form a fixing nip between the fixing rotator and the opposed rotator. The lateral end heater is disposed on the pressure pad to heat a lateral end of the fixing rotator in the axial direction of the fixing rotator. The thermal conduction aid is interposed between the pressure pad and the fixing rotator to decrease a temperature gradient of the fixing rotator in an axial direction of the fixing rotator. The pressure pad includes a nip-side face disposed opposite the thermal conduction aid. The lateral end heater includes a nip-side face being disposed opposite the thermal conduction aid and projecting beyond the nip-side face of the pressure pad.

13 Claims, 9 Drawing Sheets

(52) U.S. Cl.
CPC ..... *G03G 15/2046* (2013.01); *G03G 15/2057* (2013.01); *G03G 2215/0132* (2013.01); *G03G 2215/2035* (2013.01)

(58) Field of Classification Search
CPC ..... G03G 15/2082; G03G 15/2089; G03G 2215/2035; G03G 15/2042; G03G 2215/0132
See application file for complete search history.

(56) References Cited

U.S. PATENT DOCUMENTS

| | | | | |
|---|---|---|---|---|
| 2013/0243465 | A1* | 9/2013 | Honda ..... | G03G 15/2053 399/69 |
| 2016/0161890 | A1 | 6/2016 | Shoji et al. | |
| 2016/0223961 | A1* | 8/2016 | Takagi ..... | G03G 15/2053 |
| 2016/0274511 | A1 | 9/2016 | Ogino et al. | |
| 2016/0274514 | A1 | 9/2016 | Ishii et al. | |
| 2016/0334742 | A1 | 11/2016 | Kobashigawa et al. | |
| 2016/0378027 | A1 | 12/2016 | Sawada et al. | |

FOREIGN PATENT DOCUMENTS

| | | |
|---|---|---|
| JP | 2010-078839 | 4/2010 |
| JP | 2014-056146 | 3/2014 |
| JP | 2014-178370 | 9/2014 |

* cited by examiner

FIXING DEVICE HAVING A LATERAL END HEATER AND IMAGE FORMING APPARATUS INCORPORATING SAME

CROSS-REFERENCE TO RELATED APPLICATIONS

This patent application is based on and claims priority pursuant to 35 U.S.C. § 119(a) to Japanese Patent Application Nos. 2016-041328, filed on Mar. 3, 2016, and 2017-003241, filed on Jan. 12, 2017, in the Japan Patent Office, the entire disclosure of each of which is hereby incorporated by reference herein.

BACKGROUND

Technical Field

Embodiments of the present disclosure generally to a fixing device and an image forming apparatus, and more particularly, to a fixing device for fixing a toner image on a recording medium and an image forming apparatus for forming an image on a recording medium and incorporating the fixing device.

Related Art

Various types of electrophotographic image forming apparatuses are known, including copiers, printers, facsimile machines, and multifunction machines having two or more of copying, printing, scanning, facsimile, plotter, and other capabilities. Such image forming apparatuses usually form an image on a recording medium according to image data. Specifically, in such image forming apparatuses, for example, a charger uniformly charges a surface of a photoconductor as an image bearer. An optical writer irradiates the surface of the photoconductor thus charged with a light beam to form an electrostatic latent image on the surface of the photoconductor according to the image data. A developing device supplies toner to the electrostatic latent image thus formed to render the electrostatic latent image visible as a toner image. The toner image is then transferred onto a recording medium either directly, or indirectly via an intermediate transfer belt. Finally, a fixing device applies heat and pressure to the recording medium bearing the toner image to fix the toner image onto the recording medium. Thus, the image is formed on the recording medium.

Such a fixing device typically includes a fixing rotator, such as a roller, a belt, and a film, and an opposed rotator, such as a roller and a belt, pressed against the fixing rotator. As a recording medium bearing a toner image is conveyed between the fixing rotator and the opposed rotator, the fixing rotator and the opposed rotator apply heat and pressure to the recording medium, melting and fixing the toner image onto the recording medium.

SUMMARY

In one embodiment of the present disclosure, a novel fixing device is described that includes an endless fixing rotator, an opposed rotator, a pressure pad, a lateral end heater, and a thermal conduction aid. The fixing rotator is formed into a loop and rotatable in a direction of rotation. The opposed rotator is disposed opposite an outer circumferential surface of the fixing rotator. The pressure pad is disposed opposite the inner circumferential surface of the fixing rotator. The pressure pad presses against the opposed rotator via the fixing rotator and forms a fixing nip between the fixing rotator and the opposed rotator. The lateral end heater is disposed on the pressure pad. The lateral end heater heats a lateral end of the fixing rotator in the axial direction of the fixing rotator. The thermal conduction aid is interposed between the pressure pad and the fixing rotator. The thermal conduction aid decreases a temperature gradient of the fixing rotator in an axial direction of the fixing rotator. The pressure pad includes a nip-side face disposed opposite the thermal conduction aid. The lateral end heater includes a nip-side face disposed opposite the thermal conduction aid. The nip-side face of the lateral end heater projects beyond the nip-side face of the pressure pad.

Also described is a novel image forming apparatus incorporating the fixing device.

BRIEF DESCRIPTION OF THE DRAWINGS

A more complete appreciation of the disclosure and many of the attendant advantages thereof will be more readily obtained as the same becomes better understood by reference to the following detailed description of embodiments when considered in connection with the accompanying drawings, wherein.

The accompanying drawing are intended to depict embodiments of the present disclosure and should not be interpreted to limit the scope thereof. Also, identical or similar reference numerals designate identical or similar components throughout the several views.

DETAILED DESCRIPTION

Figure 1:
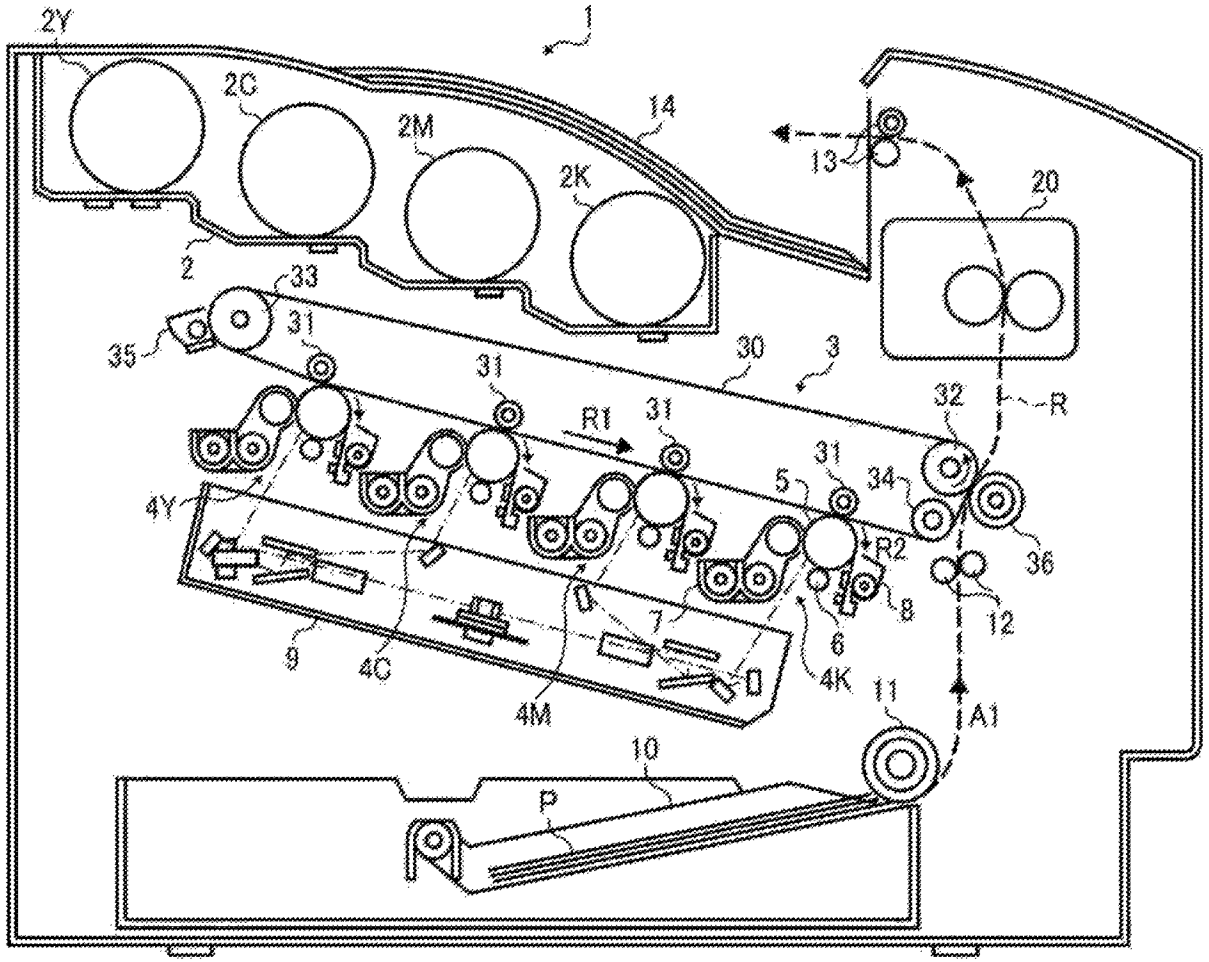
FIG. 1 is a schematic view of an image forming apparatus according to an embodiment of the present disclosure.

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and not all of the components or elements described in the embodiments of the present disclosure are indispensable to the present disclosure.

In a later-described comparative example, embodiment, and exemplary variation, for the sake of simplicity like reference numerals are given to identical or corresponding constituent elements such as parts and materials having the same functions, and redundant descriptions thereof are omitted unless otherwise required.

As used herein, the singular forms "a", "an", and "the" are intended to include the plural forms as well, unless the context clearly indicates otherwise.

It is to be noted that, in the following description, suffixes Y, C, M, and K denote colors yellow, cyan, magenta, and black, respectively. To simplify the description, these suffixes are omitted unless necessary.

Referring now to the drawings, embodiments of the present disclosure are described below.

Initially with reference to FIG. 1, a description is given of an overall construction of an image forming apparatus 1 according to an embodiment of the present disclosure.

FIG. 1 is a schematic view of the image forming apparatus 1.

The image forming apparatus 1 may be a copier, a facsimile machine, a printer, a multifunction peripheral or multifunction printer (MFP) having at least one of copying, printing, scanning, facsimile, and plotter functions, or the like. According to the present embodiment, the image forming apparatus 1 is a color printer that forms color and monochrome toner images on a recording medium by electrophotography. Alternatively, the image forming apparatus 1 may be a monochrome printer that forms a monochrome toner image on a recording medium.

As illustrated in FIG. 1, the image forming apparatus 1 includes, e.g., four image forming devices 4Y, 4C, 4M, and 4K and an intermediate transfer belt 30. The image forming devices 4Y, 4C, 4M, and 4K are situated in the center of a housing of the image forming apparatus 1, and arranged side by side along a direction in which the intermediate transfer belt 30 is stretched. The image forming devices 4Y, 4C, 4M, and 4K have identical configurations while containing different colors of toner as developer. Specifically, the image forming devices 4Y, 4C, 4M, and 4K contain toner of yellow (Y), cyan (C), magenta (M), and black (K), respectively. The colors yellow, cyan, magenta, and black correspond to color separation components of a color image.

Each of the image forming devices 4Y, 4C, 4M, and 4K is an image station that includes, e.g., a drum-shaped photoconductor 5 as a latent image bearer, a charger 6 that charges the surface of the photoconductor 5, a developing device 7 that supplies toner to an electrostatic latent image formed on the surface of the photoconductor 5, and a cleaner 8 that cleans the surface of the photoconductor 5, as illustrated in the image forming device 4K of FIG. 1, for example.

Below the image forming devices 4Y, 4M, 4C, and 4K is an exposure device 9 that exposes the surface of the photoconductor 5. The exposure device 9 includes, e.g., a light source, a polygon mirror, an f-θ lens, and a reflection mirror to irradiate the surface of the photoconductor 5 with a laser beam according to image data.

A transfer device 3 is disposed above the image forming devices 4Y, 4C, 4M, and 4K. The transfer device 3 includes the intermediate transfer belt 30 as a transfer body, four primary transfer rollers 31 as primary transfer devices, a secondary transfer roller 36 as a secondary transfer device, a secondary transfer backup roller 32, a cleaning backup roller 33, a tension roller 34, and a belt cleaner 35.

The intermediate transfer belt 30 is an endless belt entrained around the secondary transfer backup roller 32, the cleaning backup roller 33, and the tension roller 34. In the present embodiment, as a driver drives and rotates the secondary transfer backup roller 32 counterclockwise, the intermediate transfer belt 30 rotates in a counter-clockwise direction of rotation R1 as illustrated in FIG. 1 by friction therebetween.

The four primary transfer rollers 31 sandwich the intermediate transfer belt 30 together with the respective photoconductors 5, thereby forming four primary transfer areas herein referred to as primary transfer nips between the intermediate transfer belt 30 and the photoconductors 5. The primary transfer rollers 31 are coupled to a power supply disposed inside the image forming apparatus 1. The power supply applies at least one of a predetermined direct current (DC) voltage and a predetermined alternating current (AC) voltage to each of the primary transfer rollers 31.

The secondary transfer roller 36 sandwiches the intermediate transfer belt 30 together with the secondary transfer backup roller 32, thereby forming a secondary transfer area herein referred to as a secondary transfer nip between the secondary transfer roller 36 and the intermediate transfer belt 30. Similar to the primary transfer rollers 31, the secondary transfer roller 36 is coupled to the power supply disposed inside the image forming apparatus 1. The power supply applies at least one of a predetermined direct current (DC) voltage and a predetermined alternating current (AC) voltage to the secondary transfer roller 36.

The belt cleaner 35 includes a cleaning brush and a cleaning blade that contact an outer circumferential surface of the intermediate transfer belt 30.

A bottle holder 2 is disposed in an upper portion of the housing of the image forming apparatus 1. The bottle holder 2 accommodates removable four toner bottles 2Y, 2C, 2M, and 2K that contain fresh toner of yellow, cyan, magenta, and black, respectively. Toner supply tubes are interposed between the toner bottles 2Y, 2C, 2M, and 2K and the respective developing devices 7. The fresh toner is supplied from the toner bottles 2Y, 2C, 2M, and 2K to the respective developing devices 7 through the toner supply tubes.

In a lower portion of the housing of the image forming apparatus 1 are, e.g., a sheet tray 10 and a sheet feeding roller 11. The sheet tray 10 accommodates a plurality of sheets P as recording media. The sheet feeding roller 11 picks up and feeds the plurality of sheets P one at a time from the sheet tray 10 toward the secondary transfer nip formed between the secondary transfer roller 36 and the intermediate transfer belt 30. The sheets P as recording media may be plain paper, thick paper, postcards, envelopes, thin paper, coated paper, art paper, tracing paper, overhead projector (OHP) transparencies, and the like. Optionally, the image forming apparatus 1 may include a bypass feeder that imports such recording media placed on a bypass tray into the image forming apparatus 1.

In a housing of the image forming apparatus 1 is a conveyance passage R defined by internal components of the image forming apparatus 1. Along the conveyance passage R, the sheet P is conveyed from the sheet tray 10 to a sheet ejection roller pair 13 via the secondary transfer nip. The sheet ejection roller pair 13 ejects the sheet P outside the housing of the image forming apparatus 1. Along the conveyance passage R are, e.g., a registration roller pair 12, a fixing device 20, and the sheet ejection roller pair 13. The registration roller pair 12 is disposed upstream from the secondary transfer roller 36 in a direction of sheet conveyance A1 as a direction of recording medium conveyance. The registration roller pair 12, as a conveyance device, conveys the sheet P to the secondary transfer nip.

The fixing device 20 is disposed downstream from the secondary transfer roller 36 in the direction of sheet conveyance A1. The fixing device 20 receives the sheet P bearing a toner image and fixes the toner image on the sheet P. The sheet ejection roller pair 13 is disposed downstream from the fixing device 20 in the direction of sheet conveyance A1. The sheet ejection roller pair 13 ejects the sheet P onto an output tray 14. The output tray 14 is disposed atop the housing of the image forming apparatus 1. The plurality of sheets P ejected, by the sheet election roller pair B rests on the output tray 14 one by one.

To provide is fuller understanding of embodiments of the present disclosure, a description is now given of an image forming operation of the image forming apparatus 1 with continued reference to FIG. 1.

When a print job starts, a driver drives and rotates the photoconductor 5 of each of the image forming devices 4Y, 4C, 4M and 4K in a clockwise direction of rotation R2 as illustrated in FIG. 1. The charger 6 uniformly charges the surface of the photoconductor 5 to a predetermined polarity. The exposure device 9 irradiates the charged surface of the photoconductor 5 with a laser beam to form an electrostatic latent image on the surface of the photoconductor 5 according to image data. It is to be noted that the image data is single-color image data obtained by separating a desired full-color image into individual color components, that is, yellow, cyan, magenta, and black components. The developing device 7 supplies toner to the electrostatic latent image thus formed on the surface of the photoconductor 5 to render the electrostatic latent image visible as a toner image.

Meanwhile, when the print job starts, the secondary transfer backup roller 32 is rotated counterclockwise in FIG. 1 to rotate the intermediate transfer belt 30 in the direction of rotation R1. The power supply applies a constant voltage or constant current control voltage having a polarity opposite a polarity of the toner to each of the primary transfer rollers 31. Accordingly, a transfer electric field is generated at each of the primary transfer nips between the primary transfer rollers 31 and the respective photoconductors 5.

When the toner image formed on the photoconductor 5 reaches rise primary transfer nip in accordance with rotation of the photoconductor 5, the transfer electric field thus generated transfers the toner image from the photoconductor 5 onto the intermediate transfer belt 30. Specifically, toner images of yellow, cyan, magenta, and black are superimposed one atop another while being transferred onto the intermediate transfer belt 30. Thus, a full-color toner image is formed on the surface of the intermediate transfer belt 30. After the primary transfer of the yellow, cyan, magenta, and black toner images from the photoconductors 5 onto the intermediate transfer belt 30, the cleaners 8 remove residual toner, which has failed to be transferred onto the intermediate transfer belt 30 and therefore remaining on the photoconductors 5, from the photoconductors 5, respectively. Then, a discharger discharges the surface of the photoconductor 5 to initialize the surface potential of the photoconductor 5.

In the lower portion of the image forming apparatus 1, the sheet feeding roller 11 starts rotation to feed the sheet P from the sheet tray 10 toward she registration roller pair 12 along she conveyance passage R. The activation of the registration roller pair 12 is timed to convey the sheet P to the secondary transfer nip between the secondary transfer roller 36 and the intermediate transfer belt 30 so that the sheet P meets the full-color toner image formed on the surface of the intermediate transfer belt 30 at the secondary transfer nip. The secondary transfer roller 36 is supplied with a transfer voltage having a polarity opposite a polarity of the charged toner contained in the full-color toner image formed on the intermediate transfer belt 30, thereby generating a transfer electric field at the secondary transfer nip.

When the full-color toner image formed on the intermediate transfer belt 30 reaches the secondary transfer nip in accordance with rotation of the intermediate transfer belt 30, the transfer electric field thus generated transfers the toner images of yellow, cyan, magenta, and black constructing the full-color toner image from the intermediate transfer belt 30 onto the sheet P collectively. The belt cleaner 35 removes residual toner, which has failed to be transferred onto the sheet P and therefore remaining on the intermediate transfer belt 30, from the intermediate transfer belt 30. The removed toner is conveyed and collected into the waste toner container disposed in the housing of the image forming apparatus 1.

The sheet P bearing the full-color toner image is conveyed to the fixing device 20 that fixes the full-color toner image on the sheet P. Then, the sheet P bearing the fixed full-color toner image is conveyed to the sheet ejection roller pair 13 that ejects the sheet P onto the output try 14 atop the image forming apparatus 1. Thus, the plurality of sheets P rests on the output tray 14.

As described above, the image forming apparatus 1 forms a full-color image on a recording medium. Alternatively, the image forming apparatus 1 may use one of the image forming devices 4Y, 4C, 4M, and 4K to form a monochrome image, or may use two or three of the image forming devices 4Y, 4C, 4M, and 4K to form a bicolor or tricolor image, respectively.

Figure 2:
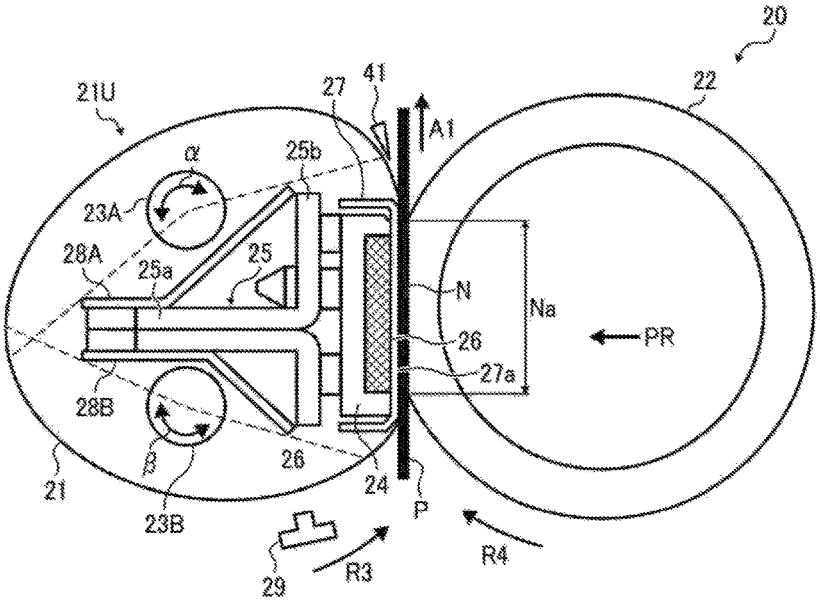
FIG. 2 is a schematic cross-sectional view of a fixing device incorporated in the image forming apparatus of FIG. 1.

Referring now to FIG. 2, a description is given of a construction of the fixing device 20 incorporated in the image forming apparatus 1 described above.

FIG. 2 is a schematic cross-sectional view of the fixing device 20.

The fixing device 20 (e.g., a fuser or a fuser unit) includes a fixing belt 21 formed into a loop, a pressure roller 22, a temperature sensor 29, a separator 41, and various components disposed inside the loop formed by the fixing belt 21 such as a plurality of heaters 23, a nip formation pad 24, a stay 25, a plurality of lateral end heaters 26, a thermal conduction aid 27, and a plurality of reflectors 28. The fixing belt 21 and the components disposed inside the loop formed by the fixing belt 21 constitute a belt unit 21U detachably coupled to the pressure roller 22.

The fixing belt 21 is an endless belt that is a thin, flexible, tubular fixing rotator rotatable in a counter-clockwise direction of rotation R3 as illustrated in FIG. 2. The pressure roller 22 is an opposed rotator disposed opposite an outer circumferential surface of the fixing belt 21 and contacts the outer circumferential surface of the fixing belt 21 at an area of contact herein referred to as a fixing nip N. The pressure roller 22 is rotatable in a clockwise direction of rotation R4 as illustrated in FIG. 2.

Inside the loop formed by the fixing belt 21 are the plurality of heaters 23, the nip formation pad 24, the stay 25, the plurality of lateral end heaters 26, the thermal conduction aid 27, and the plurality of reflectors 28.

The plurality of heaters 23 radiates heat to heat the fixing belt 21. The plurality of heaters 23 includes a halogen heater 23A as a first halogen heater and a halogen heater 23B as a second halogen heater. The light radiating from the halogen heaters 23A and 23B and directly incident on the fixing belt 21 forms irradiation angles $\alpha$ and $\beta$, respectively. Each of the halogen heaters 23A and 23B is a radiant heater and functions as a main heater.

The nip formation pad 24 is a pressure pad that extends in a longitudinal direction thereof parallel to an axial direction of the fixing belt 21. The nip formation pad 24 presses against the pressure roller 22 via the fixing belt 21, thereby forming the fixing nip N between the fixing belt 21 and the pressure roller 22.

The stay 25 is a support that supports the nip formation pad 24. Specifically, the stay 25 secures and supports the nip formation pad 24 against the pressure roller 22. Accordingly, even when the nip formation pad 24 receives pressure from the pressure roller 22, the stay 25 prevents the nip formation pad 24 from being bent by the pressure, thereby maintaining a uniform width of the fixing nip N across an axial direction of the pressure roller 22, that is, a longitudinal direction of the pressure roller 22.

The nip formation pad 24 is made of a heat-resistant material heatproof up to 200° C. and having good mechanical strength. More specifically, the nip formation pad 24 is made of heat-resistant resin such as polyimide (PI) resin, polyether ether ketone (PEEK) resin, and fiberglass-reinforced PI and PEEK. Thus, the nip formation pad 24 is immune from thermal deformation at temperatures in a fixing temperature range desirable to fix a toner image on a sheet P, thereby retaining the shape of the fixing nip N and quality of the toner image formed on the sheet P.

Opposed lateral ends of the stay 25 and opposed lateral ends of the halogen heaters 23A and 23B in a longitudinal direction thereof are secured to and supported by a pair of side plates of the fixing device 20 or a pair of holders provided separately from the pair of side plates.

Figure 3:
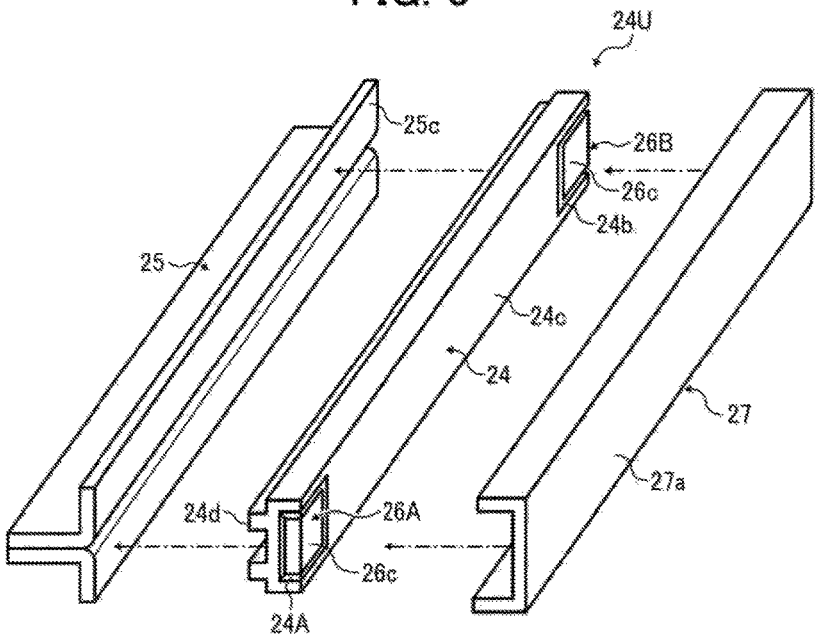
FIG. 3 is an exploded perspective view of a nip formation unit incorporated in the fixing device of FIG. 2.

The plurality of lateral end heaters 26 is provided separately from the main heaters or fixing heaters (i.e., halogen heaters 23A and 23B). The plurality of lateral end heaters 26 includes lateral end heaters 26A and 26B as illustrated in FIG. 3.

The lateral end heaters 26A and 26B are mounted on or coupled to opposed lateral ends of the nip formation pad 24 in the longitudinal direction thereof, respectively. In the present embodiment, the plurality of lateral end heaters 26 is a contact, heat-transfer heater that includes a resistive heat generator, such as a ceramic heater.

The thermal conduction aid 27 is a thermal equalizer that decreases a temperature gradient of the fixing belt 21 in the axial direction thereof. The thermal conduction aid 27 covers a nip-side face of each of the nip formation pad 24 and the plurality of lateral end heaters 26, which is disposed opposite an inner circumferential surface of the fixing belt 21. The thermal conduction aid 27 is made of a material that conducts heat quickly and well, such as copper, aluminum, and silver. Accordingly, the thermal conduction aid 27 conducts and equalizes heat in a longitudinal direction thereof parallel to the axial direction of the fixing belt 21, preventing heat from being stored at opposed lateral ends of the fixing belt 21 in the axial direction thereof while a plurality of small sheets P is conveyed over the fixing belt 21 or while the plurality of lateral end heaters 26 is turned on. Thus, the thermal conduction aid 27 eliminates uneven temperature of the fixing belt 21 in the axial direction thereof.

The thermal conduction aid 27 includes a nip-side face 27*a* being disposed opposite and in direct contact with the inner circumferential surface of the fixing belt 21. Thus, the nip-side face 27*a* serves as a nip formation face. As illustrated in FIG. 2, the nip-side face 27*a* is flattened. Alternatively, the nip-side face 27*a* may be given a concave shape or another shape. For example, a concave nip formation face directs a leading edge of the sheet P toward the pressure roller 22 as the sheet P is ejected from the fixing nip N, thereby facilitating separation of the sheet P form the fixing belt 21 and preventing a paper jam.

The temperature sensor 29 is disposed at a proper position opposite the outer circumferential surface of the fixing belt 21. For example, as illustrated in FIG. 2, the temperature sensor 29 is disposed upstream from the fixing nip N in the direction of rotation R3 of the fixing belt 21. The temperature sensor 29 detects the temperature of the fixing belt 21.

The separator 41 is disposed downstream from the fixing nip N in the direction of sheet conveyance A1 to separate the sheet P from the fixing belt 21.

A pressurization assembly presses the pressure roller 22 against the nip formation pad 24 via the fixing belt 21 and releases pressure exerted by the pressure roller 22 to the fixing belt 21.

The fixing belt 21 is an endless belt that is thin like a film and forms a loop of reduced diameter to reduce thermal capacity. The fixing belt 21 is constructed of a base layer and a release layer coating the base layer. That is, the base layer and the release layer serve as the inner and outer circumference surfaces of the fixing belt 21, respectively. The base layer is made of a metal material, such as nickel and stainless steel (e.g., steel use stainless or SUS), or a resin material such as polyimide. The release layer is made of, e.g., tetrafluoroethylene-perfluoroalkyl vinyl ether copolymer (PFA), or polyetrafluoroethylene (PTFE). Optionally, an elastic layer made of rubber such as silicone rubber, silicone rubber foam, and fluoro rubber may be interposed between the base layer and the release layer. While the fixing belt 21 and the pressure roller 22 pressingly sandwich the unfixed toner image on the sheet P to fix the toner image on the sheet P, the elastic layer having a thickness of about 100 μm elastically deforms to absorb slight surface asperities in the fixing belt 21, preventing variation in gloss of the toner image on the sheet P. In order to reduce thermal capacity, the fixing belt 21 has a total thickness not greater than 1 mm and a loop diameter in a range of from 200 mm to 40 mm. Specifically, for example, the base layer has a thickness in a range of from 20 μm to 50 μm. The elastic layer has a thickness in a range of from 100 μm to 300 μm. The release layer has a thickness in a range of from 10 μm to 50 μm. To further reduce thermal capacity, preferably, the fixing belt 21 may have a total thickness not greater than 0.2 mm, and more preferably, not greater than 0.16 mm while having a loop diameter not greater than 30 mm.

The stay 25, having a T-shaped cross-section, includes an arm 25*a* and a base 25*b* disposed opposite the fixing nip N. The arm 25*a* projects from the base 25*b* away from the fixing nip N in a direction of pressurization PR in which the pressure roller 22 presses against the nip formation pad 24 via the fixing belt 21. The arm 25*a* is interposed between the halogen heaters 23A and 23B (i.e., main heaters) to separate the halogen heaters 23A and 23B from each other.

Figure 5:
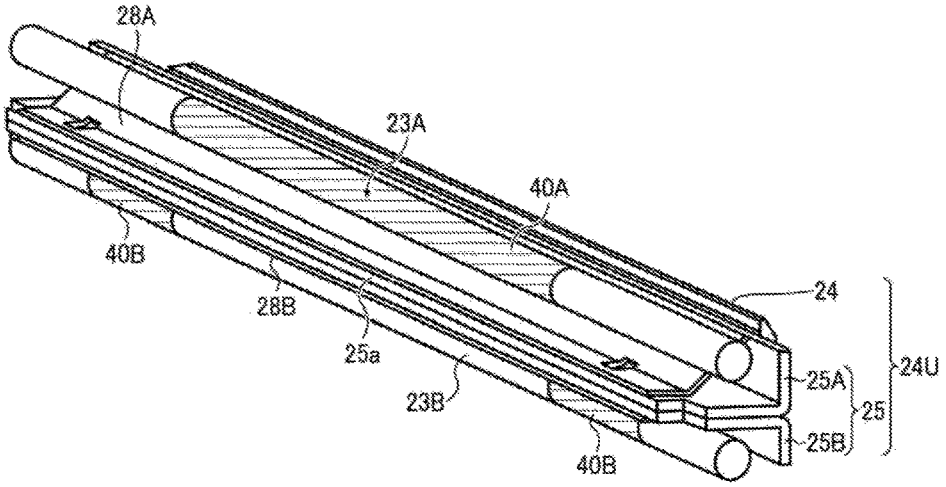
FIG. 5 is a perspective view of the nip formation unit and halogen heaters incorporated in the fixing device of FIG. 2.

One of the halogen heaters 23A and 23B includes a center heat generator to heat a small sheet P passing through the fixing nip N while the other one includes a lateral end heat generator to heat a large sheet P passing through the fixing nip N. In the present embodiment, as illustrated in FIG. 5, the halogen heater 23A as a first heater includes the center heat generator as a first heat generator disposed in a center span of the halogen heater 23A in the longitudinal direction thereof. The halogen heater 23B as a second heater includes the lateral end heat generator as a second heat generator disposed in each lateral end span of the halogen heater 23B in the longitudinal direction thereof. The power supply situated inside the image forming apparatus 1 supplies power to the halogen heaters 23A and 23B so that the halogen heaters 23A and 23B generate heat. A controller, operatively connected to the halogen heaters 23A and 23B and the temperature sensor 29, controls the halogen heaters 23A and 23B based on the temperature of the outer circumferential surface of the fixing belt 21, which is detected by the temperature sensor 29 disposed opposite the outer circumferential surface of the fixing belt 21. Thus, the temperature of the fixing belt 21 is adjusted to a desired fixing temperature.

The plurality of reflectors 28 includes reflectors 28A and 28B. The reflector 28A is interposed between the halogen heater 23A and the stay 25. The reflector 28B is interposed between the halogen heater 23B and the stay 25. In such a construction, the reflectors 28A and 28B reflect light and heat radiating from the halogen heaters 23A and 23B, respectively, toward the fixing belt 21, thus enhancing heat rug efficiency of the halogen heaters 23A and 23B to heat the fixing belt 21. In addition, the reflectors 28A and 28B prevent light and heat radiating from the halogen heaters 23A and 23B from heating the stay 25, suppressing waste of energy. Alternatively, instead of the reflectors 28A and 28B, an opposed face of the stay 25 disposed opposite the halogen heaters 23A and 23B may be insulated or given a mirror finish to reflect light and heat radiating from the halogen heaters 23A and 23B toward the fixing belt 21.

The pressure roller 22 is constructed of a core, an elastic layer coating the core, and a release layer coating the elastic layer. The elastic layer is made of rubber such as silicone rubber form and fluororubber. The release layer is made of, e.g., PFA or PTFE to facilitate separation of the sheet P from the pressure roller 22. As the pressure roller 22 is pressed against the fixing belt 21 by, e.g., a spring, the elastic layer of the pressure roller 22 is deformed, forming an area of contact (i.e., fixing nip N) having a predetermined width between the fixing belt 21 and the pressure roller 22. In the present embodiment, a driver such as a motor disposed inside the image forming apparatus 1 drives and rotates the pressure roller 22 in the direction of rotation R4.

As the driver drives and rotates the pressure roller 22, a driving force of the driver is transmitted from the pressure roller 22 to the fixing belt 21 at the fixing nip N, thereby rotating the fixing belt 21 in the detection of rotation R3. While the fixing belt 21 rotates, a nip span Na of the fixing belt 21 located at the fixing nip N is sandwiched between the pressure roller 22 and the nip formation pad 24. On the other hand, a circumferential span of the fixing belt 21 other than the nip span Na is guided by flanges secured to the pair of side plates at the opposed lateral ends of the fixing belt 21 in the axial direction thereof.

In the present embodiment, the pressure roller 22 is a solid roller. Alternatively, the pressure roller 22 may be a hollow roller, i.e., a tube. If the pressure roller 22 is a hollow roller, optionally, a heater such as a halogen heater may be disposed inside the pressure roller 22. The elastic layer of the pressure roller 22 may be made of solid rubber. Alternatively, if not heater is situated inside the pressure roller 22, the elastic layer of the pressure roller 22 may be made of sponge rubber. The sponge rubber is preferable to the solid rubber because the sponge rubber has enhanced insulation that draws less heat from the fixing belt 21.

Referring now to FIG. 3, a description is given of a construction of a nip formation unit 24U incorporated in the fixing device 20 described above.

FIG. 3 is an exploded perspective view of the nip formation unit 24U, illustrating a basic structure of the nip formation unit 24U.

As illustrated in FIG. 3, the nip formation unit 24U includes the nip formation pad 24, the stay 25, the thermal conduction aid 27, and the lateral end heaters 26A and 26B. The nip formation pad 24 includes a nip-side face 24*c* facing the fixing nip N and a stay-side face 24*d* being opposite the nip-side face 24*c* and facing the stay 25. The stay 25 includes a planar nip-side face 25*c* facing the fixing nip N. The stay-side face 24*d* of the nip formation pad 24 contacts the nip-side face 25*c* of the stay 25. Thus, the nip formation pad 24 and the stay 25 are coupled to each other. For example, the stay-side face 24*d* of the nip formation pad 24 and the nip-side face 25*c* of the stay 25 mount a recess and a projection (e.g., a boss and a pin), respectively, so that the stay-side face 24*d* engages the nip-side face 25*c* to restrict each other to the shape of the stay-side face 24*d* and the nip-side face 25*c*. The thermal conduction aid 27 engages the nip formation pad 24 given an approximately rectangular shape such that the thermal conduction aid 27 covers the nip-side face 24*c* of the nip formation pad 24 that is disposed opposite the inner circumferential surface of the fixing belt 21. Thus, the thermal conduction aid 27 is coupled to the nip formation pad 24.

In the present embodiment, the thermal conduction aid 27 engages the nip formation pad 24 with, e.g., a projection. Alternatively, the thermal conduction aid 27 may be attached to the nip formation pad 24 with, e.g., an adhesive. The nip formation pad 24 includes two recesses 24*a* and 24*b*, which define a difference in thickness of the nip formation pad 24, at the opposed lateral ends of the nip formation pad 24 in the longitudinal direction thereof. The lateral end heaters 26A and 26B are accommodated by and secured to the recesses 24*a* and 24*b*, respectively. Thus, in the embodiments of the present disclosure, the lateral end heaters 26A and 26B are disposed in the recesses 24*a* and 24*b* of the nip formation pad 24, respectively. Alternatively, the nip formation pad 24 may include planar or convex portions on which the lateral end heaters 26A and 26B may be disposed. A description of the relative positions of the lateral end heaters 26A and 26B and the halogen heaters 23A and 23B is deferred.

As described above, the thermal conduction aid 27 includes the nip-side face 27*a* that is disposed opposite the inner circumferential surface of the fixing belt 21. The nip-side face 27*a* serves as a slid face over which the fixing belt 21 slides. However, since the nip-side face 24*a* of the nip formation pad 24 is mechanically stronger than the nip-side face 27*a* of the thermal conduction aid 27, the nip-side face 24*c* of the nip formation pad 24 serves as a nip formation face that faces the pressure roller 22 and forms the fixing nip N practically.

Thus, in the embodiments of the present disclosure, the lateral end heaters 26A and 26B are coupled to the nip formation pad 24 that forms the fixing nip N. Such a construction makes good use of limited space because the lateral end heaters 26A and 26B are situated inside the limited space inside the loop formed by the fixing belt 21. In addition, since the lateral end heaters 26A and 26B are disposed opposite the fixing nip N, the lateral end heaters 26A and 26B heat the fixing nip span Na of fixing belt 21.

In other words, unlike comparative fixing devices, the lateral end heaters 26A and 26B of the fixing device 20 do not heat the circumferential span of the fixing belt 21 outboard from the nip span Na. Accordingly, the lateral end heaters 26A and 26B prevent residual toner, which has failed to be fixed on a previous sheet P and therefore adhering to the fixing belt 21, from being melted again and degrading a toner image on a subsequent sheet P.

Figure 4:
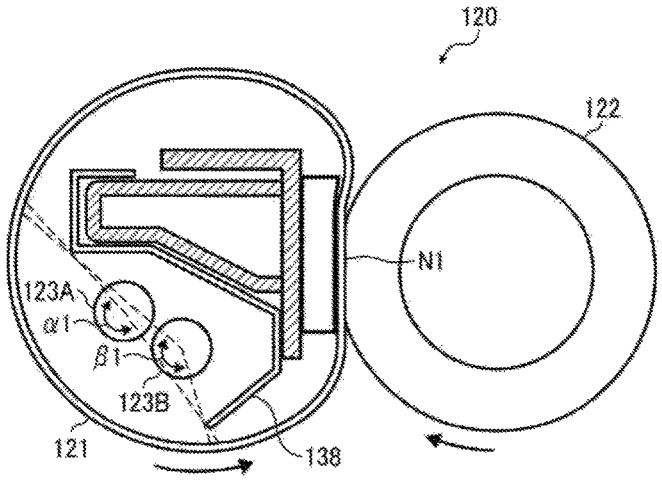
FIG. 4 is a schematic cross-sectional view of a comparative fixing device.

Referring now to FIG. 4, a description is given of an example of such comparative fixing devices.

FIG. 4 is a schematic cross-sectional view of a comparative fixing device 120.

The comparative fixing device 120 includes an endless fixing belt 121 and a pressure roller 122 disposed opposite the fixing belt 121 and contacts an outer circumferential surface of the fixing belt 121, thereby forming an area of contact, herein referred to as a fixing nip N1, between the fixing belt 121 and the pressure roller 122. In the comparative fixing device 120, halogen heaters 123A and 123B are arranged side by side as illustrated in FIG. 4. The halogen heater 123A heats a center span of the fixing belt 121 in an axial direction, that is, a longitudinal direction, of the fixing belt 121. The halogen heater 12B heats opposed lateral end spans of the fixing belt 121 in the axial direction thereof. Since the halogen heaters 123A and 123B are parallel to each other, one of the halogen heaters 123A and 123B may heat the other one of the halogen heaters 123A and 123B with radiant heat. In addition, a reflector 138 substantially surrounding the two halogen heaters 123A and 123B may disturb heating of the fixing belt 121 with radiation light reflected from the reflector 138 and narrow irradiation angles $\alpha 1$ and $\beta 1$ formed by light radiating from the halogen heaters 123A and 123B, respectively, and directly incident on the fixing belt 121. As a consequence, the heating efficiency may be degraded in heating the fixing belt 121.

Relatedly, an image forming apparatus incorporating the comparative fixing device 120 may form toner images on sheets of various sizes. The comparative fixing device 120 may further include lateral end heaters, provided separately from the halogen heaters 123A and 123B, to heat the toner images on the sheets of various sizes. For example, the lateral end heaters may be disposed opposite the lateral ends of the fixing belt 121, upstream from the fixing nip N1 in a direction of rotation of the fixing belt 121, so as to contact an inner or outer circumferential surface of the fixing belt 121.

However, in the comparative fixing device 120 including different heaters, heat from the heaters may be inefficiently transmitted to the fixing belt 121, causing uneven temperature of the fixing belt 121 in the axial direction thereof and thereby degrading the formed image.

Hence, according to the embodiments of the present disclosure, the fixing device 20 addresses these circumstances. Specifically, the fixing device 20 eliminates uneven temperature of the fixing belt 121 in the axial direction thereof while fixing toner images onto sheets P of various sizes.

Referring now to FIG. 5, a description is given of a construction of the nip formation unit 24U and the halogen heaters 23A and 23B.

FIG. 5 is a perspective view of the nip formation unit 24U and the halogen heaters 23A and 23B.

As illustrated in FIG. 5, the stay 25 includes a first portion 25A and a second portion 25B, each of which is substantially L-shaped in cross-section. Thus, the stay 25 is substantially T-shaped in cross-section. Accordingly, the stay 25 attains an enhanced rigidity that prevents the nip formation pad 24 from being bent by pressure from the pressure roller 22. The stay 25 constructed of the first portion 25A and the second portion 25B extends linearly in the longitudinal direction of the nip formation pad 24. The stay 25 is secured to the nip formation pad 24. Accordingly, the stay 25 stabilizes the nip-side face 24*c* illustrated in FIG. 3 of the nip formation pad 24 to form the fixing nip N precisely throughout the entire width of the fixing nip N in the longitudinal direction of the nip formation pad 24.

As illustrated in FIG. 5, the halogen heater 23A is disposed opposite the halogen heater 23B via the arm 25*a* of the stay 25 in a short direction perpendicular to the longitudinal direction of the stay 25. The halogen heater 23A as a first heater includes a center heat generator 40A as a first heat generator in the longitudinal direction thereof to heat a center span of the fixing belt 21. The halogen heater 23B as a second heater includes a lateral end heat generator 40B as a second heat generator in the longitudinal direction thereof to heat each lateral end span of the fixing belt 21. Thus, the heat generators 40A and 40B differ from each other in location in the longitudinal direction of the halogen heaters 23A and 23B parallel to the axial direction of the fixing belt 21. The arm 25*a* as a partition or a support screens the halogen heater 23A from the halogen heater 23B. Accordingly, while the halogen heaters 23A and 23B are powered on, glass tubes of the halogen heaters 23A and 23B, respectively, do not heat each other, preventing degradation in heating efficiency of the halogen heaters 23A and 23B. As illustrated in FIG. 2, neither of the halogen heaters 23A and 23B is surrounded by the stay 25. For example, a center of each of the halogen heaters 23A and 23B in cross-section is outside a space defined or enclosed by the stay 25. Accordingly, the irradiation angles $\alpha$ and $\beta$ are obtuse angles and improve heating efficiency.

In the present embodiment, as described above, the stay 25 has a substantially T-shaped cross-section. Alternatively, the stay 25 may be given another cross-sectional shape, provided that the arm 25*a* interposed between the halogen heaters 23A and 23B screens the halogen heater 23A from the halogen heater 23B. For example, the first portion 25A and the second portion 25B may curve and extend in the longitudinal direction of the halogen heaters 23A and 23B. The arm 25*a* of each of the first portion 25A and the second portion 25B may be oblique relative to the nip-side face 24*c* of the nip formation pad 24.

Figure 6:
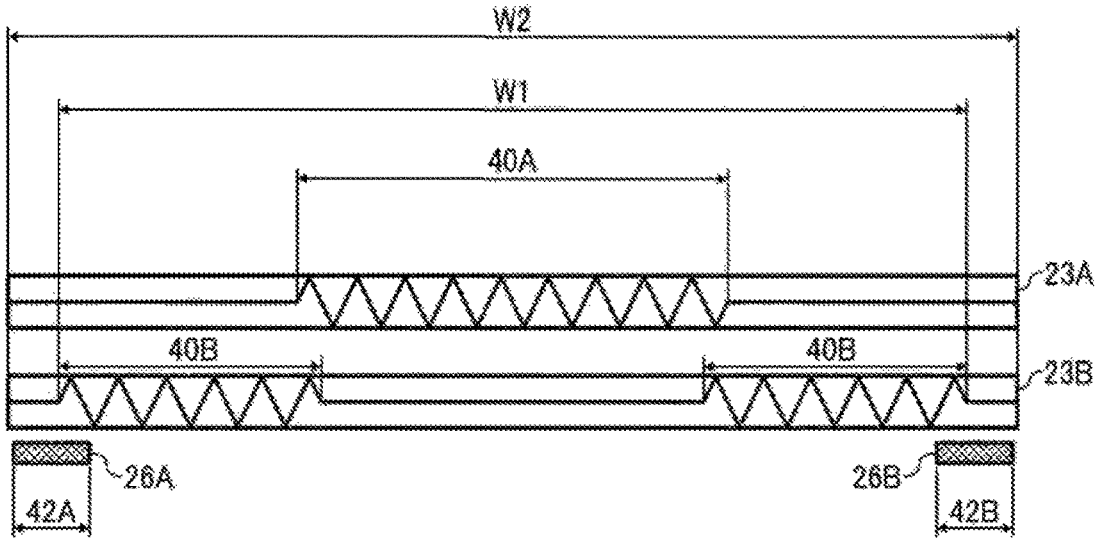
FIG. 6 is a diagram illustrating arrangement of heat generators of the halogen heaters and heat generators of lateral end heaters incorporated in the nip formation unit of FIG. 3.

Referring now to FIG. 6, a description is now given of arrangement of the heaters to heat toner images on sheets P of special sizes such as an A3 extension size sheet.

FIG. 6 is a diagram illustrating arrangement of heat generators of the halogen heaters 23A and 23B and the lateral end heaters 26A and 26B.

As illustrated in FIG. 6, the halogen heater 23A includes the center heat generator 40A having a dense light distribution in the center span of the halogen heater 23A disposed opposite the center span of the fixing belt 21 in the axial direction thereof. By contrast, the halogen heater 23B includes the lateral end heat generator 40B having a dense light distribution in each lateral end span of the halogen heater 23B disposed opposite each lateral end span of the fixing belt 21 in the axial direction thereof. The lateral end heat generator 40B is disposed outboard from the center heat generator 40A in the axial direction of the fixing belt 21. In short, the halogen heater 23A heats the center span of the fixing belt 21 in the axial direction thereof. The halogen heater 23B heats each lateral end span of the fixing belt 21 in the axial direction thereof.

The center heat generator 40A of the halogen heater 23A heats toner images on small size sheets P such as A4 size sheets in portrait orientation. By contrast, the lateral end heat generator 40B of the halogen heater 23B heats toner images on large size sheets P which the center heat generator 40A is insufficient to heat. For example, lateral end heat generator 40B heats a toner image on a maximum standard size sheet P conveyable in the fixing device 20, such as an A3 size sheet in portrait orientation. The lateral end heat generator 40B is disposed outboard from the center heat generator 40A in the longitudinal direction of the halogen heaters 23A and 23B (i.e., axial direction of the fixing belt 21) so that the lateral end heat generator 40B heats a lateral end of the maximum standard sue sheet P that is outboard from the center heat generator 40A in the longitudinal direction of the halogen heaters 23A and 23B. As illustrated in FIG. 6, the heat generators 40A and 40B has a heat generation span W1, which corresponds to a width of the maximum standard size sheet P. However, the heat generation span W1 does not encompass a width of an extension size sheet P that is greater than the maximum standard size sheet P.

On the other hand, the lateral end heaters 26A and 26B are disposed opposite the opposed lateral ends of the halogen heater 23B in the longitudinal direction thereof, respectively. The lateral end heater 26A includes a heat generator or heat generation span 42A. Similarly, the lateral end heater 26B includes a heat generator or heat generation span 42B. The heat generators 42A and 42B respectively heat opposed lateral ends of the extension size sheet P, which is greater than the maximum standard size sheet P, in a width direction of the extension size sheet P parallel to the longitudinal direction of the halogen heater 23B. FIG. 6 illustrates the heat generators 42A and 42B as heat generators of the lateral end heaters 26A and 26B, respectively. More specifically, the heat generators 42A and 42B are longitudinal heat generation spans of the lateral end heaters 26A and 26B, respectively, in the axial direction the fixing belt 21. In addition, the lateral end heaters 26A and 26B respectively include width heat generation spans 43A and 43B, as illustrated in FIGS. 8B and 9B, in a direction perpendicular to the axial direction of the fixing belt 21.

That is, the longitudinal heat generation span 42A as a first heat generation span and the width heat generation span 43A as a second heat generation span define an entire heat generator or heat generation span of the lateral end heater 26A. Similarly, the longitudinal heat generation span 42B as a first heat generation span and the width heat generation span 43B as a second heat generation span define an entire heat generator or heat generation span of the lateral end heater 26B. Each of the heat generators or heat generation spans thus defined is provided with a pattern of a resistive heat generator 51 described below, namely, a heat generation pattern 37. A part of each of the heat generators 42A and 42B overlaps the lateral end heat generator 40B in the longitudinal direction of the halogen heater 23B. Accordingly, the fixing belt 21 of the fixing device 20 heats the opposed lateral ends of the extension size sheet P greater than the maximum standard size sheet P in the width direction of the extension size sheet P. That is, a heat generation span W2 of the respective heat generators 40A and 40B of the halogen heaters 23A and 23B and the respective heat generators 42A and 42B of the lateral end heaters 26A and 26B corresponds to the width of the extension size sheet P that is greater than the maximum standard size sheet P. In other words, the heat generation span W2 of the heat generators of the halogen heaters 23A and 23B and the lateral end heaters 26A and 26B encompasses the width of the extension size sheet P.

Figure 7:
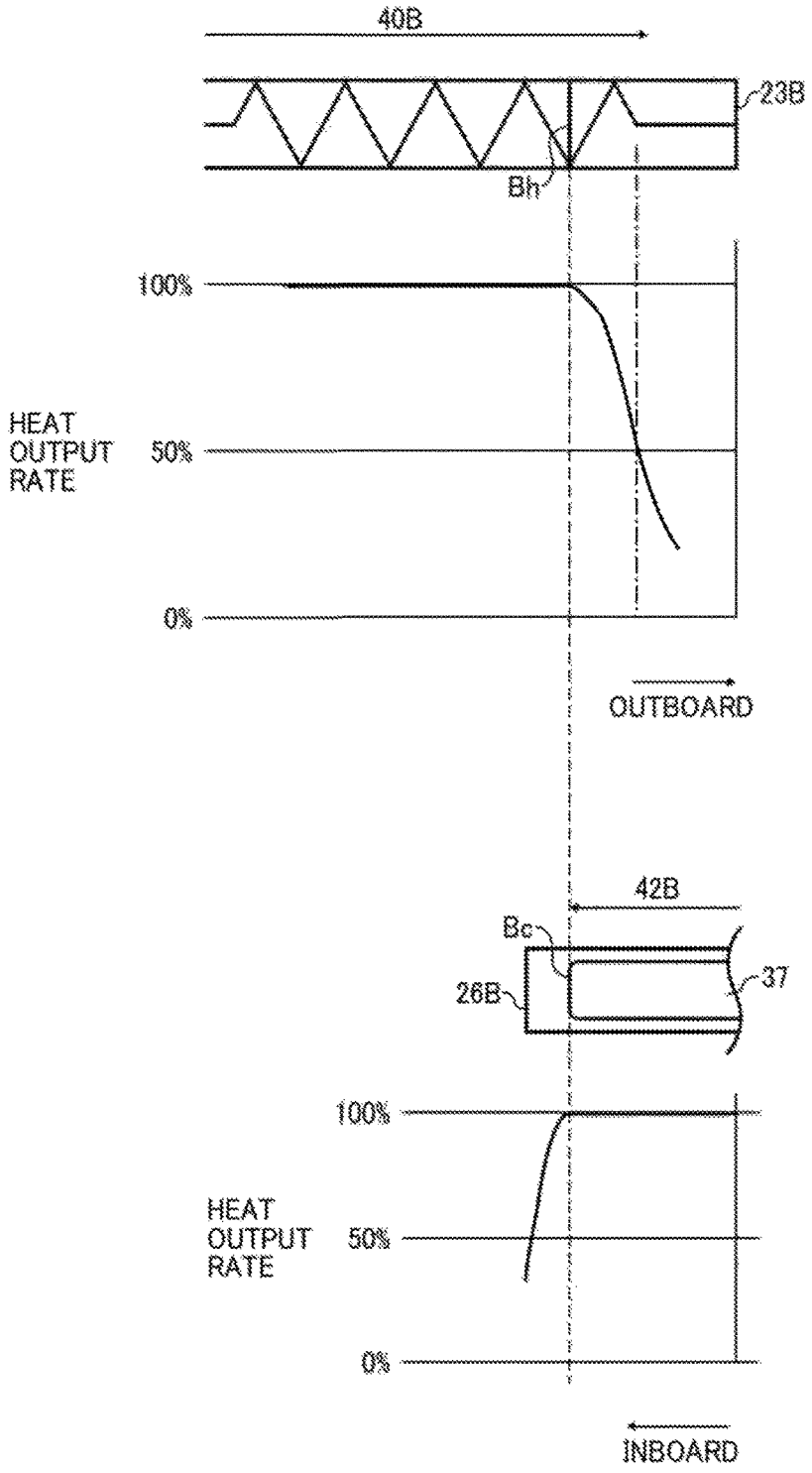
FIG. 7 is a diagram illustrating the relative positions of the heat generator of the halogen heater and the heat generator of the lateral end heater, with heat output rates of the heat generators.

Referring now to FIG. 7, a description is now given of an amount of heat output by the halogen heaters 23A and 23B and the lateral end heaters 26A and 26B to heat the fixing belt 21.

FIG. 7 is a diagram illustrating the relative positions of the lateral end heat generator 40B of the halogen heater 23B and the heat generator 42B of the lateral end heater 26B, with heat output rates of the heat generators 40B and 42B.

An upper part of FIG. 7 illustrates a right lateral end of the lateral end heat generator 40B of the halogen heater 23B. A lower part of FIG. 7 illustrates a left lateral end of the heat generator 42B of the lateral end heater 26B.

Generally, a heat generator, in which a filament is coiled helically, of a halogen heater suffers from decrease in heat output at a lateral end of the heat generator in a longitudinal direction of the halogen heater. The decrease in heat output varies depending on a density of the filament coiled helically. The smaller the density of the filament coiled helically, the more the halogen heater is susceptible to the decrease in heat output. As illustrated in the upper part in FIG. 7, a lateral end of the lateral end heat generator 40B in the longitudinal direction of the halogen heater 23B that suffers from the decrease in heat output is defined as a span from a position at which the lateral end heat generator 40B attains a predetermined heat output rate of 100% to a position at which the lateral end heat generator 40B suffers from a decreased heat output rate of 50%, for example.

As illustrated in the lower part in FIG. 7, a lateral end of the lateral end heater 26B that is inboard from the heat generator 42B in a longitudinal direction of the lateral end heater 26B suffers from the decrease in heat output. The lateral end of the lateral end heater 26B in the longitudinal direction thereof fails to attain the predetermined heat output rate of 100% and suffers from a decreased heat output rate.

Accordingly, as the lateral end of each of the halogen heater 23B and the lateral end heater 26B in the longitudinal direction thereof suffers from the decrease in heat output, a toner image formed on the lateral end of the extension size sheet P greater than the maximum standard size sheet P may not be fixed on the extension size sheet P properly.

To address this circumstance, in the embodiments of the present disclosure, a border Bh at which heat output from the lateral end heat generator 40B of the halogen heater 23B starts decreasing corresponds to a border Bc at which heat output from the heat generator 42B of the lateral end heater 26B starts decreasing, as illustrated in FIG. 7. Since the halogen healer 23B is spaced apart from the lateral end heater 26B as illustrated in FIG. 2, the border Bh coincides with the border Bc in the longitudinal direction of the halogen heater 23B on a projection. Similarly, the border Bh at which heat output from the other lateral end heat generator 40B of the halogen heater 23B starts decreasing corresponds to the border Bc at which heat output from the heat generator 42A of the lateral end heater 26A starts decreasing.

Accordingly, the total heat output does not decrease in an overlap span where the lateral end heat generator 40B of the halogen heater 23B overlaps the lateral end heater 26B and an overlap span where the other lateral end heat generator 40B of the halogen heater 23B overlaps the heat generation span 26A in the longitudinal direction of the halogen heater 23B. Thus, the heat generation span W2 of the heat generators 40A, 40B, 42A, and 42B retains the predetermined heat output rate of 100 percent. As a consequence, even when the extension size sheet P greater than the maximum standard size sheet P is conveyed over the fixing belt 21, the toner image formed on each lateral end of the extension size sheet P in the width direction thereof is fixed on the extension size sheet P properly.

In the embodiments of the present disclosure, as illustrated in FIG. 2, the border Bh at which heat output from the heal generator 40B of the halogen heater 23B starts decreasing coincides with the border Bc at which heat output from the heat generator 42B of the lateral end heater 26B starts decreasing. Alternatively, however, the position of the border Bc at which heat output from the respective heat generators 42A and 42B of the lateral end heaters 26A and 26B starts decreasing may be determined within a predetermined allowable range. This is because the thermal conduction aid 27 of the nip formation unit 24U has an enhanced thermal conductivity that offsets a certain amount of decrease in heat output front the heat generators 40B, 42A, and 42B and therefore equalizes the temperature of the fixing belt 21.

A description is now given of an advantageous configuration of the thermal conduction aid 27.

If the fixing belt 21 slides directly on the thermal conduction aid 27, the thermal conduction aid 27 made of metal may increase a coefficient of friction between the inner circumferential surface of the fixing belt 21 and the thermal conduction aid 27. As the coefficient of friction increases, a unit torque of the fixing device 20 may increase, hampering proper rotation of the fixing belt 21.

Hence, in the embodiments of the present disclosure, the nip-side face 27*a* of the thermal conduction aid 27 that is disposed opposite the inner circumferential surface of the fixing belt 21 is coated with a fluorine material such as PFA and PTFE or treated with other coating to reduce friction between the thermal conduction aid 27 and the inner circumferential surface of the fixing belt 21. As a consequence, the fixing belt 21 slides over the thermal conduction aid 27 in good condition.

In addition, a lubricant such as fluorine grease and silicone oil may be applied between the thermal conduction aid 27 and the inner circumferential surface of the fixing belt 21 to reduce a sliding torque over a relatively long period of time.

A description is now given of a construction of the nip formation pad 24, the lateral end heaters 26A and 26B, and the thermal conduction aid 27.

As illustrated in FIG. 3, each of the lateral end heaters 26A and 26B includes a nip-side face 26*c* disposed opposite the inner circumferential surface of the fixing belt 21. If the nip-side face 26*c* of each of the lateral end heaters 26A and 26B is designed to be leveled with the nip-side face 24*c* of the nip formation pad 24, which is disposed opposite the inner circumferential surface of the fixing belt 21, so that the nip-side faces 26*c* and the nip-side face 24*c* define an identical plane, variation in parts may hamper formation of a target shape as designed. If the nip-side face 24*c* of the nip formation pad 24 projects beyond the nip-side face 26*c* of the lateral end heaters 26A and 26B, the lateral end heaters 26A and 26B do not contact the thermal conduction aid 27. In other words, heat from the lateral end heaters 26A and 26B is not conducted to the fixing belt 21 through the thermal conduction aid 27, causing uneven temperature of the fixing belt 21 in the axial direction thereof. According to the embodiments of the present disclosure, the fixing device 20 addresses this circumstance.

Referring now to FIGS. 8A through 11, a description is given of four embodiments of the construction of the nip formation pad 24, the lateral end heaters 26A and 26B, and the thermal conduction aid 27.

Figure 8A:
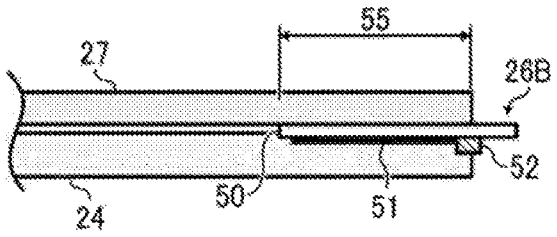
FIG. 8A is a cross-sectional view of a nip formation pad the lateral end heater, and a thermal conduction aid incorporated in the fixing device of FIG. 2, according to a first embodiment.
Figure 8B:
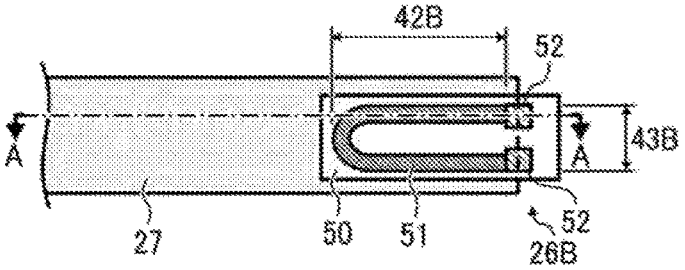
FIG. 8B is a front view of the lateral end heater, and the thermal conduction aid of FIG. 8A.
Figure 8C:
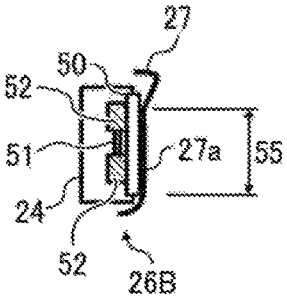
FIG. 8C is a side view of the nip formation pad, the lateral end heater, and the thermal conduction aid of FIG. 8A.

Initially with reference to FIG. 8A through 8C, a description is given of a construction of the nip formation pad 24, the lateral end heater 26B, and the thermal conduction aid 27 according to a first embodiment of the present disclosure.

FIG. 8A is a cross-sectional view of the nip formation pad 24, the lateral end heater 26B, and the thermal conduction aid 27. FIG. 8B is a front view of the lateral end heater 26B and the thermal conduction aid 27 of FIG. 8A. FIG. 8C is a side view of the nip formation pad 24, the lateral end heater 26B, and the thermal conduction aid 27 of FIG. 8A.

Specifically, FIG. 8A is a cross-sectional view of the nip formation pad 24, the lateral end heater 26B, and the thermal conduction aid 27 along a line A-A of FIG. 8B, seen in the direction of sheet conveyance A1. Although FIGS. 8A through 8C illustrate a construction of only one of the opposed lateral ends of the nip formation pad 24 and the thermal conduction aid 27 together with the lateral end heater 26B, a construction of the other one of the opposed lateral ends of the nip formation pad 24 and the thermal conduction aid 27 together with the lateral end heater 26A is similar to the construction illustrated in FIGS. 8A through 8C.

As illustrated in FIGS. 8A through 8C, the lateral end healer 26B is a resistive heat generation unit that includes a base 50, the resistive heat generator 51, and a plurality of electrodes 52. The resistive heat generator 51 is mounted on the base 50 and is substantially U-shaped, for example, as illustrated in FIG. 8B. The plurality of electrodes 52 supplies power to the resistive heat generator 51. For example, the lateral end heater 26B is a ceramic heater that includes the base 50 made of, e.g., ceramic and the resistive heat generator 51 mounted on the base 50.

As illustrated in FIG. 8B, the electrodes 52 are disposed outboard from the longitudinal heat generator 42B of the lateral end heater 26B in the longitudinal direction of the lateral end heater 26B parallel to the axial direction of the fixing belt 21. The electrodes 52 are coupled to opposed lateral ends of the resistive heat generator 51 in the longitudinal direction of the lateral end heater 26B, respectively. As the electrodes 52 are supplied with power, the resistive heat generator 51 generates heat to increase the temperature of the longitudinal heat generation span 42B defined by the resistive heat generator 51. In order to prevent overheating of the electrodes 52, the electrodes 52 are disposed outboard from the longitudinal heat generation span 42B of the lateral end heater 26B in the longitudinal direction of the lateral end heater 26B. As described above, the longitudinal heat generation span 42A in the axial direction of the fixing belt 21 and the width heat generation span 43A in the direction perpendicular to the axial direction of the fixing belt 21 define the entire heat generator or heat generation span of the lateral end heater 26A. Similarly, the longitudinal heat generator 42B in the axial direction of the fixing belt 21 and the width heat generation span 43B in the direction perpendicular to the axial direction of the fixing belt 21 define the entire heat generator or heat generation span of the lateral end heater 26B.

The width heat generation span 43B is smaller than the width of the thermal conduction aid 27. The electrodes 52 are attached to the resistive heat generator 51 by soldering to supply power to the resistive heat generator 51. Since the soldering provides low heat resistance, the electrodes 52 may be attached to the resistive heat generator 51 with high melting point solder or silver to increase heat resistance of the electrodes 52.

The thermal conduction aid 27 contacts the base 50 of the lateral end heater 26B in a contact area 55 and covers the entire heat generator of the lateral end heater 26B, which is defined by the longitudinal heat generation span 42B and the width heat generation span 43B. FIG. 8 schematically illustrates the thermal conduction aid 27. As illustrated in FIG. 8, the thermal conduction aid 27 may project toward the pressure roller 22 at a position in proximity to and upstream from an exit of the fixing nip N in the direction of rotation R3 of the fixing belt 21. Thus, the thermal conduction aid 27 facilitates separation of the sheet P from the fixing belt 21 at the exit of the fixing nip N.

As specifically illustrated in FIG. 3, the lateral end heaters 26A and 26B are disposed in the recesses 24*a* and 24*b* formed at the opposed lateral ends of the nip formation pad 24 in the longitudinal direction thereof, respectively. As illustrated in FIG. 8C, the nip-side face 26*c* of the lateral end heater 26B that is disposed opposite the inner circumferential surface of the fixing belt 21 projects beyond the nip-side face 24*c* of the nip formation pad 24 that is disposed opposite the inner circumferential surface of the fixing belt 21. Therefore, in the contact area 55, the lateral end heater 26B reliably contacts the thermal conduction aid 27. Similarly, the lateral end heater 26A reliably contacts the thermal conduction aid 27. As a consequence, heat from the lateral end heaters 26A and 26B is efficiently conducted to the fixing belt 21 through the thermal conduction aid 27. Thus, the thermal conduction aid 27 eliminates uneven temperature of the fixing belt 21 in the axial direction thereof.

Figure 9A:
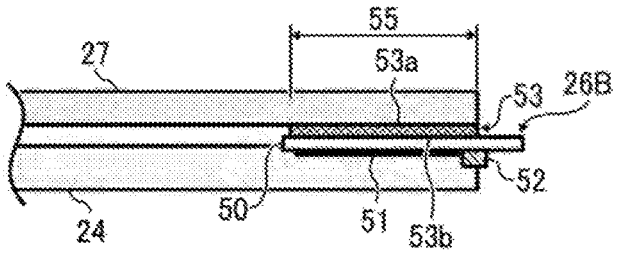
FIG. 9A is a cross-sectional view of the nip formation pad, the lateral end heater, and the thermal conduction aid according to a second embodiment.
Figure 9B:
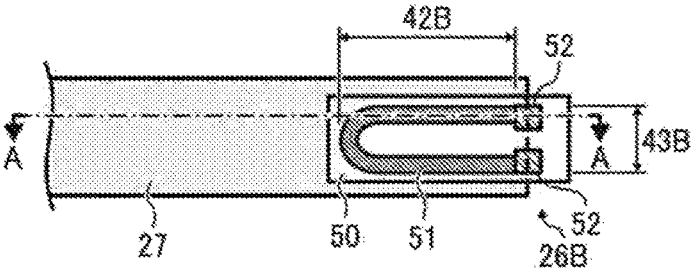
FIG. 9B is a front view of the lateral end heater, and the thermal conduction aid of FIG. 9A.
Figure 9C:
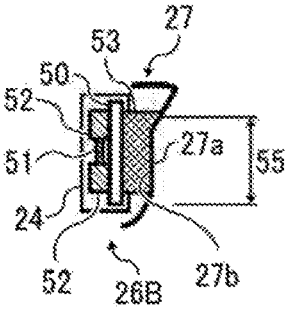
FIG. 9C is a side view of the nip formation pad, the lateral end heater, and the thermal conduction aid of FIG. 9A.

Referring now to FIGS. 9A through 9C, a description is given of a construction of the nip formation pad 24, the lateral end heater 26B, and the thermal conduction aid 27 according to a second embodiment of the present disclosure.

FIG. 9A is a cross-sectional view of the nip formation pad 24, the lateral end heater 26B, and the thermal conduction aid 27. FIG. 9B is a front view of the lateral end heater 26B and the thermal conduction aid 27 of FIG. 9A. FIG. 9C is a side view of the nip formation pad 24, the lateral end heater 26B, and the thermal conduction aid 27 of FIG. 9A.

Specifically, FIG. 9A is a cross-sectional view of the nip formation pad 24, the lateral end heater 26B, and the thermal conduction aid 27 along a line A-A of FIG. 9B, seen in the direction of sheet conveyance A1. Although FIGS. 9A through 9C illustrate a construction of one of the opposed lateral ends of the nip formation pad 24 and the thermal conduction aid 27 together with the lateral end heater 26B, a construction of the other one of the opposed lateral ends of the nip formation pad 24 and the thermal conduction aid 27 together with the lateral end heater 26A is similar to the construction illustrated in FIGS. 9A through 9C.

As illustrated in FIGS. 9A and 9B, the lateral end heater 26B is a flat plate. By contrast, as illustrated in FIG. 9C, the thermal conduction aid 27 has a complex curve in cross-section. If a heater-side face 27*b* of the thermal conduction aid 27 that is disposed opposite the lateral end heater 26B is barely flat, the thermal conduction aid 27 may contact the lateral end heater 26B in a decreased area.

Hence, in the present embodiment, an interposer 53 is interposed between the thermal conduction aid 27 and the lateral end heater 26B as illustrated in FIGS. 9A and 9C. A nip-side face 53*a* of the interposer 53 that is disposed opposite the thermal conduction aid 27 has a shape that conforms to or engages the thermal conduction aid 27. A heater-side face 53*b* of the interposer 53 that is disposed opposite the lateral end heater 26B has a shape that conforms to or engages the lateral end heater 26B. Preferably, the interposer 53 corresponds to the size of the entire heat generator of the lateral end heater 26B, which is defined by the longitudinal heat generation span 42B and the width heat generation span 43B.

The interposer 53 is made of, e.g., copper, aluminum, or an alloy of copper and aluminum. Preferably, a thermal conductivity of the interposer 53 is not smaller than a thermal conductivity of the thermal conduction aid 27. If the thermal conductivity of the interposer 53 is smaller than the thermal conductivity of the thermal conduction aid 27, the interposer 53 may degrade conduction of heat from the lateral end heater 26B to the thermal conduction aid 27 and increases waste of heat. To address this circumstance, the thermal conductivity of the interposer 53 is not smaller than the thermal conductivity of the thermal conduction aid 27, preventing degradation in heating efficiency of the lateral end heater 26B.

The interposer 53 sandwiched between and in contact with the thermal conduction aid 27 and the lateral end heater 26B reduces heat conducted from the lateral end heater 26B to the electrodes 52 through the fixing belt 21, preventing overheating of the electrodes 52. The interposer 53 isolates the electrodes 52 from the fixing belt 21 with an increased interval therebetween, thus precisely preventing overheating of the electrodes 52 having a decreased heat resistance.

As specifically illustrated in FIG. 3, the lateral end heaters 26A and 26B are disposed in the recesses 24*a* and 24*b* formed at the opposed lateral ends of the nip formation pad 24 in the longitudinal direction thereof, respectively. As illustrated in FIG. 9C, the nip-side face 53*a* of the interposer 53 that is disposed opposite the inner circumferential surface of the fixing belt 21 projects beyond the nip-side face 24*c* of the nip formation pad 24 that is disposed opposite the inner circumferential surface of the fixing belt 21. Therefore, in the contact area 55, the lateral end heater 26B reliably contacts the thermal conduction aid 27 via the interposer 53. Similarly, the lateral end heater 26A reliably contacts the thermal conduction aid 27 via the interposer 53. As a consequence, heat from the lateral end heaters 26A and 26B is efficiently conducted to the fixing belt 21 through the thermal conduction aid 27. Thus, the thermal conduction aid 27 eliminates uneven temperature of the fixing belt 21 in the axial direction thereof.

Figure 10:
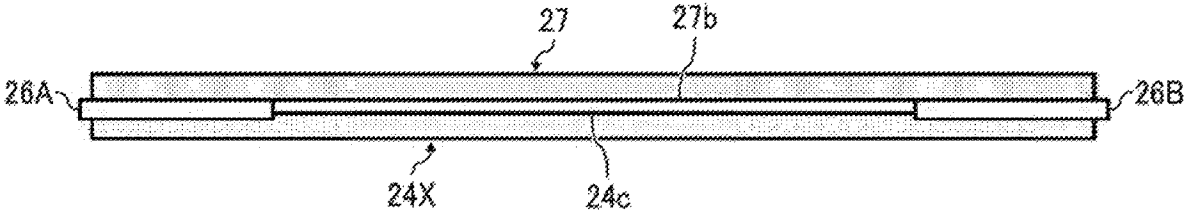
FIG. 10 is a cross-sectional view of the nip formation pad, the lateral end heater, and the thermal conduction aid according to a third embodiment.

Referring now to FIG. 10, a description is given of a construction of a nip formation pad 24X, the lateral end heater 26B, and the thermal conduction aid 27 according to a third embodiment of the present disclosure.

FIG. 10 is a cross-sectional view of the nip formation pad 24X, the lateral end heater 26B, and the thermal conduction aid 27.

The shape of the nip formation pad 24X distinguishes the third embodiment from the first embodiment described above.

As illustrated in FIG. 10, the nip formation 24X is spaced apart from the thermal conduction aid 27 with a given interval therebetween. The nip-side face 24*c* of the nip formation pad 24X that is disposed opposite the thermal conduction aid 27 has a shape that conforms to a shape of the heater-side or pad-side face 27*b* of the thermal conduction aid 27 that is disposed opposite the nip formation pad 24. Alternatively, the pad-side face 27*b* of the thermal conduction aid 27 that is disposed opposite the nip formation pad 24 may have a shape that conforms to the shape of the nip-side face 24*c* of the nip formation 24X that is disposed opposite the thermal conduction aid 27.

Accordingly, heat conducted from the lateral end heaters 26A and 26B to the thermal conduction aid 27 does not move to the nip formation pad 24X. As a consequence, heat from the lateral end heaters 26A and 26B is efficiently conducted to the fixing belt 21 through the thermal conduction aid 27. Thus, the thermal conduction aid 27 eliminates uneven temperature of the fixing belt 21 in the axial direction thereof.

Figure 11:
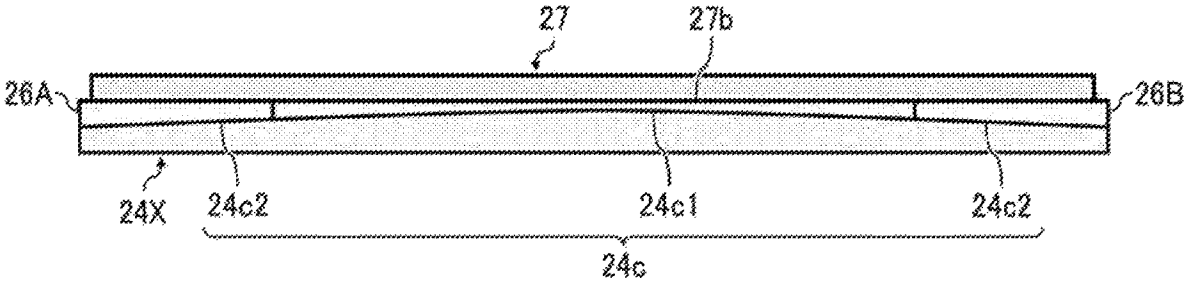
FIG. 11 is a cross-sectional view of the nip formation pad, the lateral end heater, and the thermal conduction aid according to a fourth embodiment.

Referring now to FIG. 11, a description is given of a construction of a nip formation pad 24Y, the lateral end heater 26B, and the thermal conduction aid 27 according to a fourth embodiment of the present disclosure.

FIG. 11 is a cross-sectional view of the nip formation pad 24Y, the lateral end heater 26B, and the thermal conduction aid 27.

The shape of the nip formation pad 24Y distinguishes the third embodiment from the first embodiment described above.

As illustrated in FIG. 11, the nip-side face 24*c* of the nip formation pad 24Y that is disposed opposite the thermal conduction aid 27 includes a center face 24*c*1 and opposed lateral end faces 24*c*2 in a longitudinal direction of the nip formation pad 24Y parallel to the axial direction of the fixing belt 21. The center face 24*c*1 projects beyond the lateral end faces 24*c*2. Alternatively, the pad-side face 27*b* of the thermal conduction aid 27 that is disposed opposite the nip formation pad 24 may have a center face and opposed lateral end faces in the longitudinal direction of the thermal conduction aid 27. In this case, the center face may project beyond the lateral end faces. The nip formation pad 24Y is spaced apart from the thermal conduction aid 27 with a given interval therebetween.

Such a construction prevents disease in surface pressure at a center span of the fixing nip N in the axial direction of the fixing belt 21 and the pressure roller 22 even if the nip formation pad 24X is bent by the pressure from the pressure roller 22.

Figure 12:
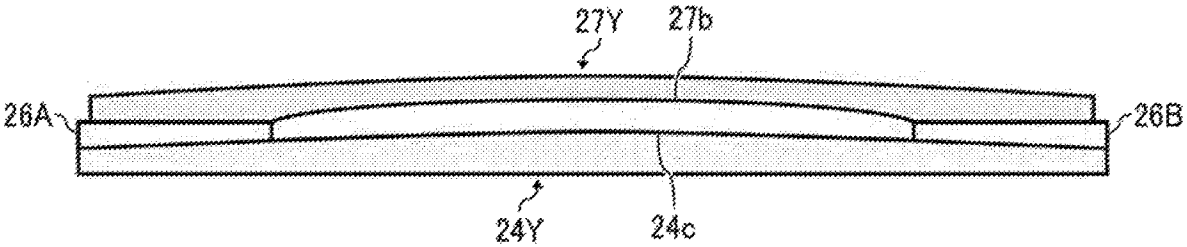
FIG. 12 is a cross-sectional view of the nip formation pad, the lateral end heater, and the thermal conduction aid according to a variation of the fourth embodiment.

Referring now to FIG. 12, a description is given of a construction of the nip formation pad 24Y, the lateral end heater 26B, and a thermal conduction aid 27Y according to a variation of the fourth embodiment of the present disclosure.

FIG. 12 is a cross-sectional view of the nip formation pad 24Y, the lateral end heater 26B, and the thermal conduction aid 27Y.

As illustrated in FIG. 12, the pad-side face 27*b* of the thermal conduction aid 27 that is disposed opposite the nip formation pad 24Y has a shape that conforms to a shape of the nip-side face 24*c* of the nip formation pad 24Y that is disposed opposite the thermal conduction aid 27Y.

Accordingly, head conducted from the lateral end heaters 26A and 26B to the thermal conduction aid 27 does not move to the nip formation pad 24Y. As a consequence, heat from the lateral end heaters 26A and 26B is efficiently conducted to the fixing belt 21 through the thermal conduction aid 27. Thus, the thermal conduction aid 27 eliminated uneven temperature of the fixing belt 21 in the axial direction thereof.

A description is now given of a configuration of another temperature detector separately provided from the temperature sensor 29 illustrated in FIG. 2, which detects the temperature of the fixing belt 21 heated by the plurality of lateral end heaters 26 (e.g., lateral end heaters 26A and 26B).

A contact sensor (e.g., a thermistor) is employed to detect the temperature of the fixing belt 21 precisely at reduced costs. However, the contact sensor may produce slight scratches at a contact area on the fixing belt 21 where the contact sensor contacts the fixing belt 21. The slight scratches may damage a toner image formed on a sheet P while the sheet P is conveyed over the fixing belt 21, generating slight variation in gloss of the toner image on the sheet P or the like. To address this circumstance, in the image forming apparatus 1 that forms a color toner image on a sheet P, the contact sensor is not situated within a conveyance span in the axial direction of the fixing belt 21 where the maximum standard size sheet P is conveyed over the fixing belt 21.

The extension size sheet P includes an extension portion used as an edge or margin abutting a toner image formed in proximity to a lateral edge of the maximum standard size sheet P, a portion where a linear image called a trim mark used for alignment in printing positions is formed, or a portion where a solid patch having a small area for color adjustment is formed. Finally, the extension portion is often trimmed. Therefore, even if the contact sensor produces scratches on the fixing belt 21 and the scratches damage a toner image formed on the extension portion of the extension size sheet P with slight variation in gloss of the toner image or the like, the damaged toner image does not appear on the extension size sheet P as a faulty toner image after the extension portion is trimmed.

Figure 13:
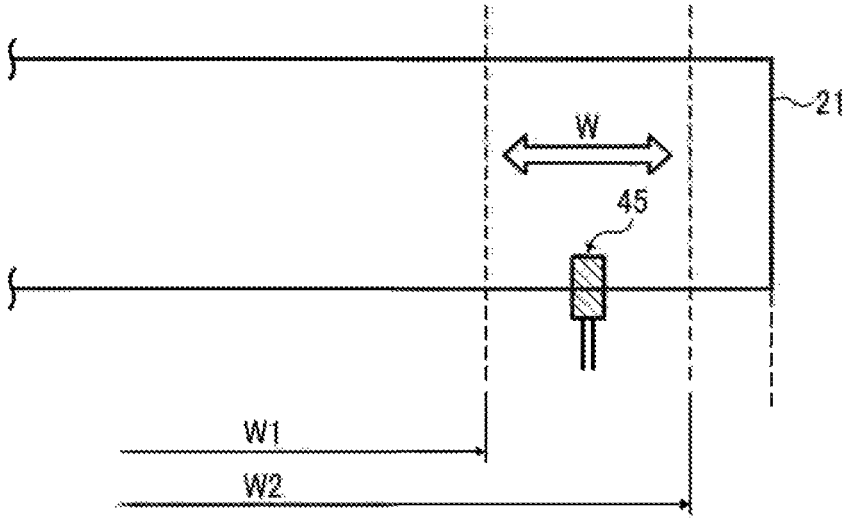
FIG. 13 is a plan view of a temperature detector and a fixing belt incorporated in she fixing device of FIG. 2.

Accordingly, as illustrated in FIG. 13, the fixing device 20 according to the present embodiment includes a temperature detector 45 disposed opposite each lateral end of the fixing belt 21 in the axial direction thereof.

FIG. 13 is a plan view of the temperature detector 45 and the fixing belt 21.

The temperature detector 45 detects the temperature of the opposed lateral ends of the fixing belt 21 heated by the lateral end heaters 26A and 26B. Specifically, the temperature detector 45 is disposed outside the heat generation span W1 that corresponds to the width of the maximum standard size sheet P and inside the heat generation span W2 that corresponds to the width of the extension size sheet P greater than the maximum standard size sheet P. That is, the temperature detector 45 is disposed within a span W being outboard from a lateral end of the maximum standard size sheet P and inboard from a lateral end of the extension size sheet P in the axial direction of the fixing belt 21. Accordingly, the temperature detector 45 precisely detects the temperature of the fixing belt 21 heated by the lateral end heaters 26A and 26B at reduced costs while preventing a faulty toner image that suffers from slight variation in gloss or the like from appearing on the extension size sheet P.

In the embodiments described above, the resistive heat generator 51 is illustrated having a U-shaped heat generation pattern in the front view, but is not limited thereto.

Figure 14:
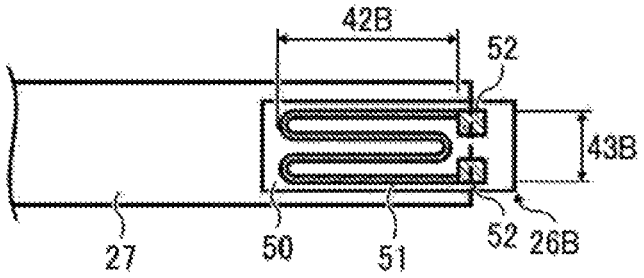
FIG. 14 is a schematic view of a variation of a heat generation pattern of a resistive heat generator incorporated in the fixing device of FIG. 2.

FIG. 14 is a schematic view of a variation of the heat generation pattern of the resistive heat generator 51.

As illustrated in FIG. 14, the resistive heat generator 51 has a serpentine shape and is positioned on the base 50 such that the resistive heat generator 51 is elongated. The resistive heat generator 51 of FIG. 14 defines the heat generation pattern that increases the heat output rate of the plurality of lateral end heaters 26.

A description is given of advantages of the fixing device 20.

As illustrated in FIG. 2, a fixing device (e.g., fixing device 20) includes a fixing rotator (e.g., fixing belt 21), an opposed rotator (e.g., pressure roller 22), a first heater (e.g., halogen heater 23A), a second heater (e.g., halogen heater 23B), a pressure pad (e.g., nip formation pad 24), a lateral end heater (e.g., lateral end heater 26), and a thermal conduction aid (e.g., thermal conduction aid 27). The fixing rotator is an endless rotator formed into a loop and rotatable in a direction of rotation (e.g., direction of rotation R3). The opposed rotator is disposed opposite an outer circumferential surface of the fixing rotator. The first and second heaters are disposed inside the loop formed by the fixing rotator, opposite the inner circumferential surface of the fixing rotator, to heat the fixing rotator. As illustrated in FIG. 5, the first heater includes a first heat generator (e.g., center heat generator 40A). The second heater includes a second heater generator (e.g., lateral end heater generator 40B) different from the first heat generator in location in an axial direction of the fixing rotator. As illustrated in FIG. 2, the pressure pad is disposed inside the loop formed by the fixing rotator, opposite the inner circumferential surface of the fixing rotator, and presses against the opposed rotator via the fixing rotator to form a fixing nip (e.g., fixing nip N) between the fixing rotator and the opposed rotator. As illustrated in FIG. 3, the lateral end heater is disposed on the pressure pad to heat a lateral end of the fixing rotator in the axial direction of the fixing rotator. As illustrated in FIG. 2, the thermal conduction aid is interposed between the pressure pad and the fixing rotator. The thermal conduction aid decreases a temperature gradient of the fixing rotator in the axial direction of the fixing rotator. As illustrated in FIG. 3, the lateral end heater includes a nip-side face (e.g., nip-side face 26*c*) disposed opposite the thermal conduction aid. The pressure pad includes a nip-side face (e.g., nip-side face 24*c*) disposed opposite the thermal conduction aid. As illustrated in FIG. 8C, the nip-side face of the lateral end heater projects beyond the nip-side face of the pressure pad.

Accordingly, the lateral end heater reliably contacts the thermal conduction aid allowing the thermal conduction aid to efficiently conduct heat from the lateral end heater to the fixing belt 21 and to eliminate uneven temperature of the fixing rotator in the axial direction thereof.

Thus, the fixing device 20 according to the embodiments of the present disclosure eliminates uneven temperature of the fixing belt 121 in the axial direction thereof while fixing toner images on sheets P of various sizes.

According to the embodiments described above, the fixing belt 21 serves as a fixing rotator. Alternatively, a fixing film, a fixing sleeve, or the like may be used as a fixing rotator. Further, the pressure roller 22 serves as a pressure rotator. Alternatively, a pressure belt of the like may be used as a pressure rotator.

The present disclosure has been described above the reference to specific embodiments. It is to be noted that the present disclosure is not limited to the details of the embodiments described above, but various modifications and enhancements are possible without departing from the scope of the present disclosure. It is therefore to be understood that the present disclosure may be practiced otherwise than as specifically described herein. For example, elements and/or features of different embodiments may be combined with each other and/or substituted for each other within the scope of the present disclosure. The number of constituent elements and their locations, shapes; and so forth are not limited to any of the structure for performing the methodology illustrated in the drawings.

Any one of the above-described operations may be performed in various other ways, for example, in an order different form the one described above.

What is claimed is:

1. A fixing device comprising:

an endless fixing rotator, formed into a loop and rotatable in a direction of rotation;

an opposed rotator disposed opposite an outer circumferential surface of the fixing rotator;

a pressure pad disposed opposite an inner circumferential surface of the fixing rotator to press against the opposed rotator via the fixing rotator to form a fixing nip between the fixing rotator and the opposed rotator, a lateral end heater disposed on the pressure pad to heat a lateral end of the fixing rotator in an axial direction of the fixing rotator without heating a central region of the fixing rotator; and a thermal conduction aid interposed between the pressure pad and the fixing rotator to decrease a temperature gradient of the fixing rotator in the axial direction of the fixing rotator, the pressure pad including a nip-side face disposed opposite the thermal conduction aid, the lateral end heater including a nip-side face, the nip-side face of the lateral end heater being disposed opposite the thermal conduction aid and projecting, in a direction towards the opposed rotator, beyond the nip-side face of the pressure pad, wherein the lateral end heater further includes a resistive heat generator, and no resistive heat generator of the fixing device is located more inboard than the lateral end heater.

2. The fixing device according to claim 1, wherein the thermal conduction aid includes a pad-side face disposed opposite the pressure pad, and wherein the nip-side face of the pressure pad is spaced apart from the pad-side of the thermal conduction aid.

3. The fixing device according to claim 1 wherein the thermal conduction aid includes a pad-side face disposed opposite the pressure pad, and wherein the nip-side face of the pressure pad has a shape that conforms to a shape of the pad-side face of the thermal conduction aid.

4. The fixing device according to claim 1, wherein the nip-side face of the pressure pad includes a center face and an end face in the axial direction of the fixing rotator, and wherein the center face projects beyond the end face.

5. The fixing device according to claim 1, further comprising an interposer interposed between the thermal conduction aid and the lateral end heater to conduct heat from the lateral end heater to the thermal conduction aid, wherein the interposer has a shape that conforms to a shape of the thermal conduction aid and a shape of the lateral end heater.

6. The fixing device according to claim 1, further comprising:

a first heater disposed opposite the inner circumferential surface of the fixing rotator to heat the fixing rotator, the first heater including a first heat generator; and a second heater disposed opposite the inner circumferential surface of the fixing rotator to heat the fixing rotator, the second heater including a second heat generator different from the first heat generator in location in the axial direction of the fixing rotator.

7. The fixing device according to claim 6, wherein the second heat generator of the second heater is disposed outboard from the first heat generator of the first heater in the axial direction of the fixing rotator.

8. The fixing device according to claim 7, wherein the lateral end heater further includes:

a first heat generation span in the axial direction of the fixing rotator; and a second heat generation span in a direction perpendicular to the axial direction of the fixing rotator, and wherein a part of the first heat generation span of the lateral end heater overlaps the second heat generator of the second heater in the axial direction of the fixing rotator.

9. The fixing device according to claim 1, wherein the lateral end heater further includes:

a first heat generation span in the axial direction of the fixing rotator; and a second heat generation span in a direction perpendicular to the axial direction of the fixing rotator, and wherein the second heat generation span of the lateral end heater is smaller than a width of the thermal conduction aid in the direction perpendicular to the axial direction of the fixing rotator.

10. The fixing device according to claim 1, wherein the thermal conduction aid contacts the lateral end heater.

11. The fixing device according to claim 1, wherein the resistive heat generator is U-shaped.

12. The fixing device according to claim 1, wherein the resistive heat generator has a serpentine shape.

13. An image forming apparatus comprising:

an image forming device to form a toner image; and the fixing device according to claim 1, the fixing device being disposed downstream from the image forming device in a direction of recording medium conveyance to fix the toner image on a recording medium.

* * * * *